US009250572B2

(12) United States Patent
Karp et al.

(10) Patent No.: US 9,250,572 B2
(45) Date of Patent: Feb. 2, 2016

(54) INK DEVELOPER UNIT, AND SEALING DEVICE USABLE WITH INK DEVELOPER UNIT

(75) Inventors: Alexander James Karp, San Diego, CA (US); James Pingel, San Diego, CA (US); David Sabo, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 90 days.

(21) Appl. No.: 13/817,064

(22) PCT Filed: Sep. 29, 2010

(86) PCT No.: PCT/US2010/050748

§ 371 (c)(1),
(2), (4) Date: Feb. 14, 2013

(87) PCT Pub. No.: WO2012/044292

PCT Pub. Date: Apr. 5, 2012

(65) Prior Publication Data

US 2013/0149002 A1 Jun. 13, 2013

(51) Int. Cl.
*G03G 15/08* (2006.01)
*G03G 15/10* (2006.01)

(52) U.S. Cl.
CPC ..... *G03G 15/0898* (2013.01); *G03G 15/10* (2013.01)

(58) Field of Classification Search
CPC ..... G03G 15/0898; G03G 15/10
USPC ..... 399/103, 105, 237
See application file for complete search history.

(56) References Cited

U.S. PATENT DOCUMENTS

| | | | | |
|---|---|---|---|---|
| 4,423,134 | A | 12/1983 | Miyakawa et al. | |
| 5,293,199 | A * | 3/1994 | Saito et al. | 399/103 |
| 5,983,053 | A * | 11/1999 | Mordenga et al. | 399/103 |
| 7,356,287 | B2 | 4/2008 | Guzman et al. | |
| 2007/0002093 | A1 | 1/2007 | Umeda | |

FOREIGN PATENT DOCUMENTS

JP 2003056713 A 2/2003

OTHER PUBLICATIONS

The International Search Report and the Written Opinion of the International Searching Authority for International App No. PCT/US2010/050748 dated Jun. 21, 2011, pp. 9.

* cited by examiner

*Primary Examiner* — Susan Lee

(57) ABSTRACT

A sealing device includes a base member configured to attach to an ink developer unit, a sealing member having a sealing surface configured to at least one of limit an unwanted flow of ink outside of the ink developer unit and conform to an outer surface of a respective roller, and a compliant member disposed between the base member and the sealing member such that the compliant member is configured to vary a sealing force along the sealing surface of the sealing member.

15 Claims, 5 Drawing Sheets

INK DEVELOPER UNIT, AND SEALING DEVICE USABLE WITH INK DEVELOPER UNIT

BACKGROUND

Ink developer units are used in image forming apparatuses to supply ink to a photoconductive drum to form images on media. Ink developer units include sealing devices to prevent ink from leaking out of the ink developer units.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is detected by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Ink developer units such as Binary Ink Developers (BIDS) include rollers and are used in image forming apparatuses such as Liquid Electrophotography Printers (LEP) to supply ink to a photoconductive drum to form images on media. Sealing devices are used in ink developer units and may be disposed on side surfaces of one or more rollers through an interference fit to prevent ink from leaking out of the ink developer units. Such sealing devices may require stringent manufacturing tolerances and have low durability. Variation of the respective tolerances may result in adverse conditions such as a premature wear condition, a product failure condition, an ink splatter condition, a fused ink condition and an ink overflow condition, or the like.

Exemplary sealing devices of the present disclosure disclose sealing devices including a sealing member having a sealing surface configured to at least one of limit an unwanted flow of ink outside of the ink developer unit and conform to an outer surface of a respective roller. The sealing device also includes a compliant member configured to vary a sealing force along the sealing surface of the sealing member. Accordingly, exemplary sealing devices of the present disclosure may increase flow rates, require less-stringent manufacturing tolerances and have high durability. Thus, the sealing devices of the present disclosure may reduce occurrences of a premature wear condition, a product failure condition, an ink splatter condition, a fused ink condition and an ink overflow condition, or the like.

Figure 1:
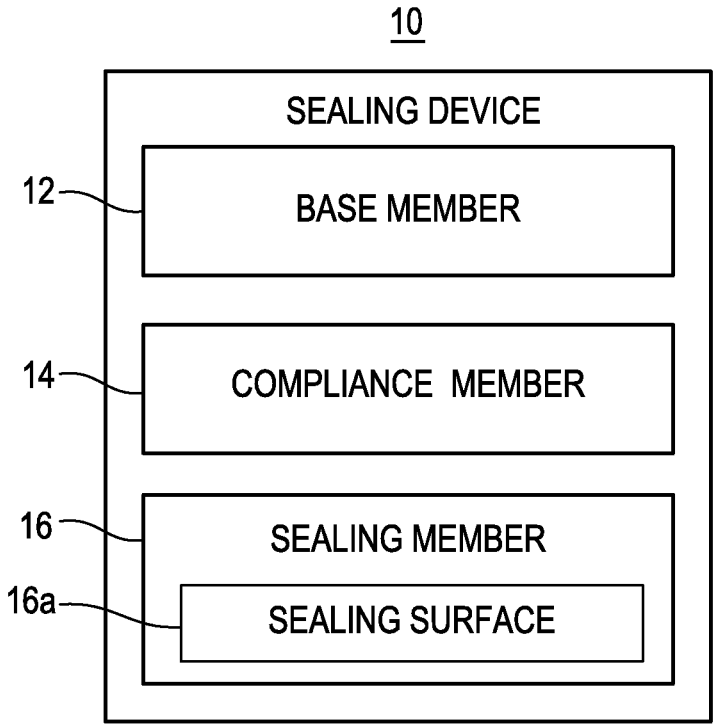
FIG. 1 is a block diagram illustrating a sealing device according to an example of the present disclosure.
Figure 2:
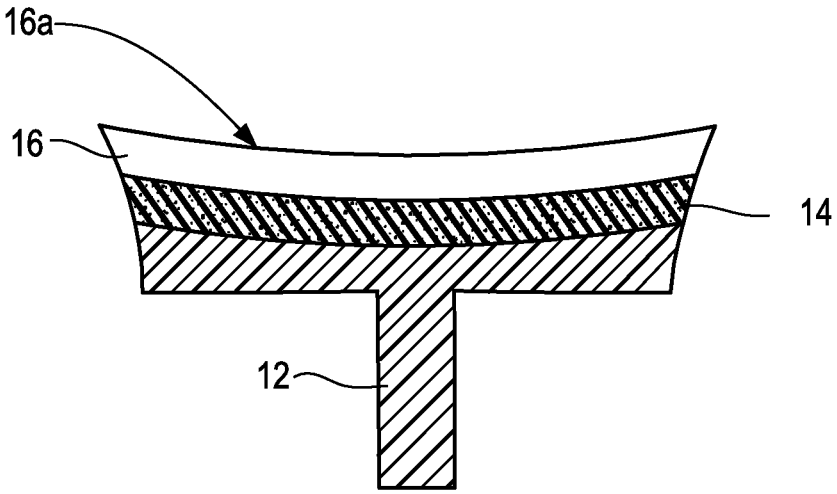
FIG. 2 is a side view of the sealing device of FIG. 1 according to an example of the present disclosure.

FIG. 1 is a block diagram illustrating a sealing device according to an example of the present disclosure. FIG. 2 is a side view of the sealing device of FIG. 1 according to an example of the present disclosure. The sealing device 10, for example, is usable with an ink developer unit (not illustrated) such as a BID. Referring to FIGS. 1 and 2, in the present example, the sealing device 10 includes a base member 12, a compliant member 14 and a sealing member 16. The base member 12 is configured to attach to the ink developer unit. In an example, the base member 10 is rigid and is configured to removably attach to the ink developer unit. The base member 12 may comprise plastic.

Referring to FIGS. 1 and 2, the sealing member 16 includes a sealing surface 16*a* configured to limit an unwanted flow of ink outside of the ink developer unit. In the present example, the ink is a liquid toner. In an example, the sealing member 16 includes material having one or more of the following properties: high abrasion resistance, low friction, low elongation and fibrous construction. In the present example, the sealing member 16 includes a material such as wool felt having all of such properties.

Referring to FIGS. 1 and 2, the compliant member 14 is disposed between the base member 12 and the sealing member 16. In the present example, the compliant member 14 is a compressibility layer. The compliant member 14 is configured to vary a sealing force along the sealing surface 16*a* of the sealing member 16. Thus, the compliant member 14 may establish non-uniform interference with other members with which it comes in direct or indirect contact. For example, ink pressure variations created by ink flow and/or rotation of rollers may require non-uniform minimum contact force from the sealing member 16 to create a sufficient seal. As a result, the sealing surface 16*a* of the sealing member 16 provides non-uniform interference on the respective roller 35*a* (FIG. 4B) contacted by the sealing surface 16*a*. The compliant layer 14 may include foam rubber. In an example, the sealing device 10 comprises a shape in a form of a T-shape.

Figure 3:
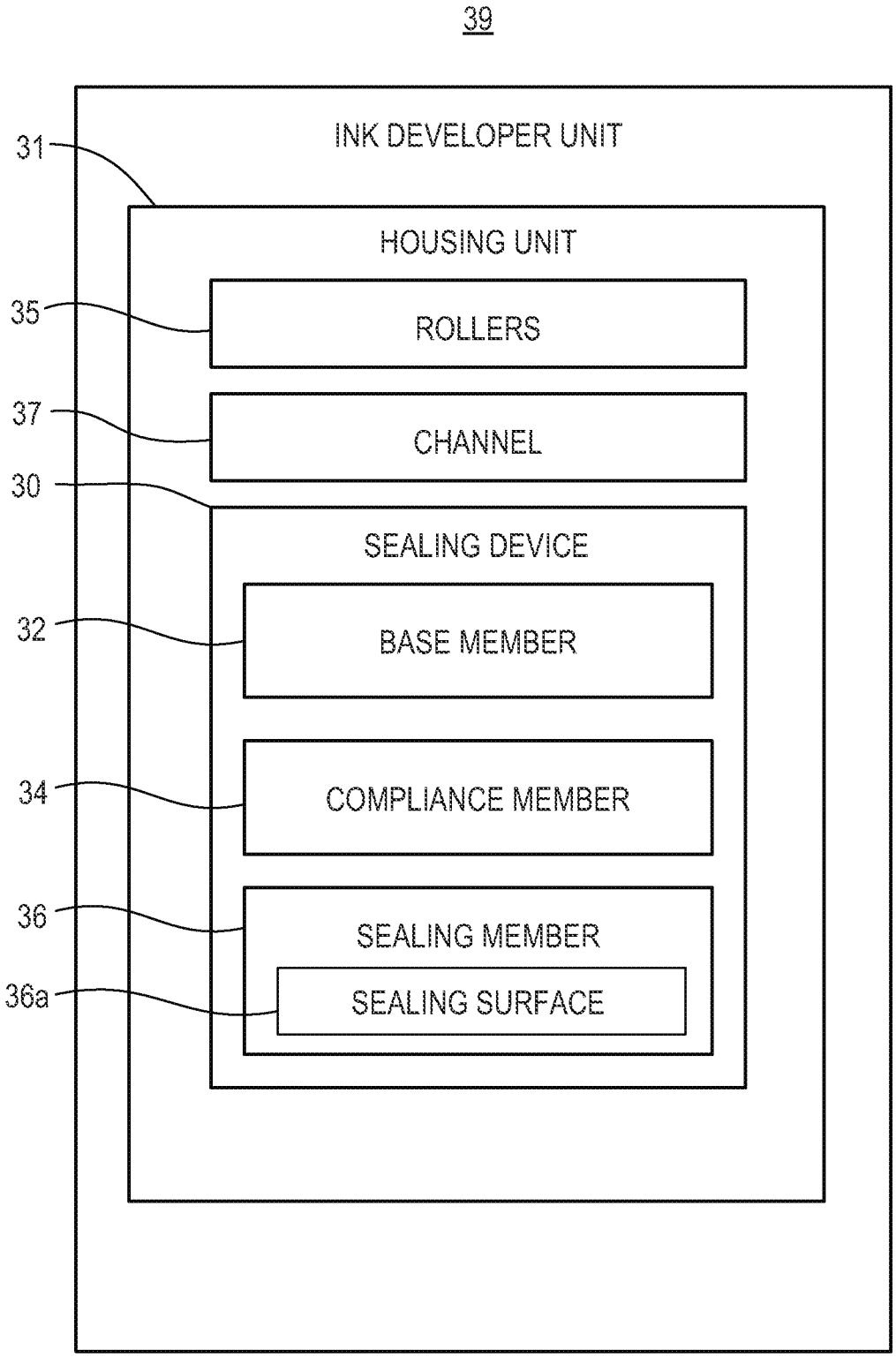
FIG. 3 is a block diagram illustrating an ink developer unit according to an example of the present disclosure.

FIG. 3 is a block diagram illustrating an ink developer unit according to an example of the present disclosure. Referring to FIG. 3, in the present example, an ink developer unit 39 such as a BID includes a housing unit 31. The housing unit 31 includes rollers 35, a channel 37, and at least one sealing device 30. The sealing device 30 includes a base member 32, a compliant member 34, and a sealing member 36. The compliant member 34 is disposed between the base member 32 and sealing member 36 as illustrated in FIG. 4B.

Figure 4A:
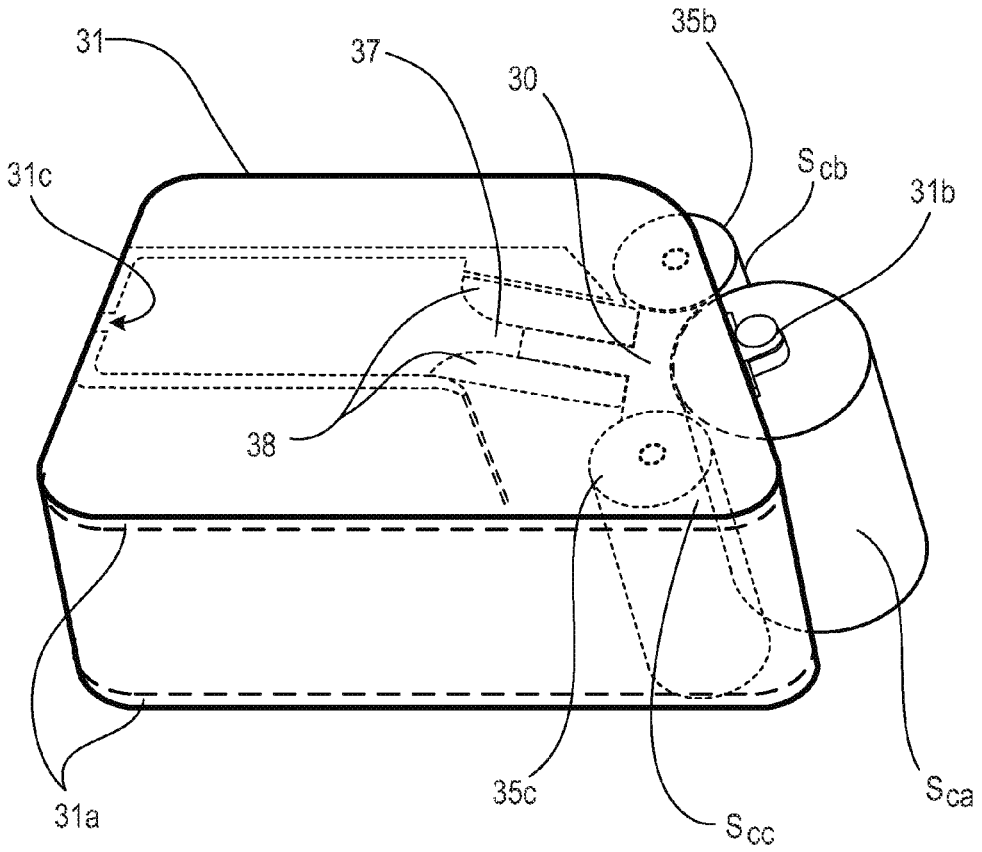
FIG. 4A is a perspective view of an ink developer unit according to an example of the present disclosure.
Figure 4B:
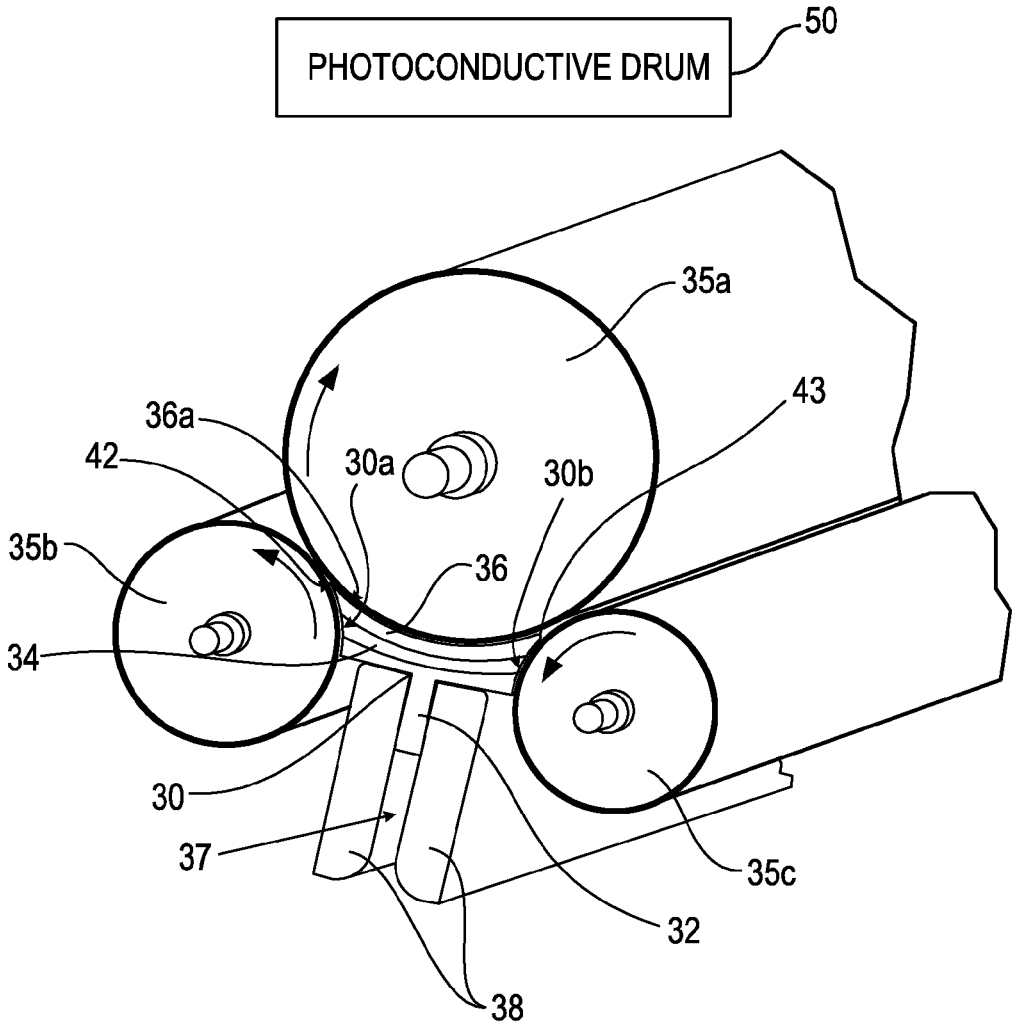
FIG. 4B is an exploded perspective view of a portion of FIG. 4A according to an example of the present disclosure.

FIG. 4A is a perspective view of an ink developer unit according to an example of the present disclosure. In the present example, the ink developer unit 39 is configured to provide a uniform film of ink to a photoconductive drum (not illustrated). The ink may be provided to the ink developer unit 39 through an ink inlet 31*c* of the housing unit 31. In the present example the ink is a liquid toner in which ink particles are suspended in a fluid carrier.

Referring to FIG. 4A, the ink developer unit 39 may include a developer roller 35*a*, a squeegee roller 35*b* and a cleaner roller 35*c* (collectively 35). The developer roller 35*a* is configured to supply a film of the ink to be selectively transferred to the photoconductive drum. The developer roller

35*a* rotates through a flow of the ink to adhere ink thereto. A pair of electrodes 38 and the developer roller 35*a* are electrically charged to manipulate the ink particles onto the developer roller 35*a*. The squeegee roller 35*b* is configured to compact the ink on the developer roller 35*a* to form a uniform layer thereon. Ink on the developer roller 35*a* is attracted and transferred to the charged portions of the photoconductive drum. The charge portions correspond to an image to be printed. The image in the form of ink is subsequently transferred to a media either directly or through an intermediate transfer member (not illustrated). The cleaner roller 35*c* is configured to remove access ink remaining on the developer roller 35*a* and not previously transferred to the photoconductive drum. In examples, the ink developer unit 39 may also include a wiper blade, a sponge roller and a squeezer roller not illustrated herein. The wiper blade may be configured to scrape excess ink from the cleaner roller 35*c*. The sponge roller may be configured to clean excess ink from the wiper blade and/or cleaner roller 35*c*. The squeezer roller may be configured to wring access ink from the sponge roller.

FIG. 4B is an exploded perspective view of a portion of FIG. 4A according to an example of the present disclosure. Referring to FIGS. 4A and 4B, in an example, the rollers 35*a*, 35*b* and 35*c* are rotatably attached to the housing unit 39. For example, the housing unit 31 may include a pair of end caps 31*a* having bearings and/or clamping portions 31*b* to rotatably hold ends of the rollers 12 having a reduced diameter. In an example, the clamping portion 31*b* may be integrally formed on the developer roller 35*a*. For example, the clamping portions 31 b may be removably fastened to end caps 31*a* of the housing unit 31 with screws and/or bolts. Accordingly, the developer roller 35*a* may be removable from the housing unit 31 of the ink developer unit 31. Accordingly, the developer roller 35*a* may be replaced when needed. In an example, the end caps 31*a* may be removable to allow components to be replaced. For example, the end caps 31*a* may be removably fastened to a main body of the housing unit 31 with screws and/or bolts. Each of the developer roller 35*a*, squeegee roller 35*b* and cleaner roller 35*c* include a circumferential surface $s_{ca}$, $s_{cb}$, and $s_{cc}$, respectively.

Referring to FIGS. 4A and 4B, in the present example, the ink developer unit 39 may be configured to removably engage with a photoconductive drum 50 (schematically shown in FIG. 4B) of an image forming apparatus such as an LEP. In an example, the housing unit 31 includes a pair of electrodes 38 configured to removably hold the base member 32 of the sealing device 30. The base member 32 may be held in a manner to prevent unintended rotation and translation of the sealing device 30. The base member 30, however, may be allowed to be manually moved in a single linear direction to allow the sealing device 30 to be replaced when needed. The base member 32 may comprise plastic. The channel 37 is disposed within the housing unit 39 and is configured to provide ink to a respective roller 12 such as the developer roller 35*a*. In an example, the pair of electrodes 38 may form the channel 37 or a portion thereof. The housing unit 31 may include an ink inlet 31*c* for ink to be provided to the channel 37. For example, a replaceable ink container (not illustrated) outside of the ink developer unit 39 may be connected to the ink inlet 31*c* through a conduit (not illustrated).

Referring to FIGS. 4A and 4B, the sealing surface 36*a* of the sealing member 36 is configured to conform to an outer surface of the developer roller 35*a* such as its circumferential surface $s_{ca}$. For example, the sealing surface 36*a* includes a concave shape to mate with a convex shape of the circumferential surface $s_{ca}$ of the developer roller 36*a*. In an example, the sealing surface 36*a* is configured to limit an unwanted flow of ink from inside to outside of the ink developer unit 39. For example, the flow of unwanted ink from the inside to the outside of the ink developer unit is limited at least by the mating of the sealing surface 36*a* with the circumferential surface $s_{ca}$ of the developer roller 35*a* and varying of a sealing force along the sealing surface 36*a* to counteract localized high ink pressure. The sealing member 36 may include wool felt. The compliant member 34 is configured to vary a sealing force along the sealing surface 36*a* of the sealing member 36. In an example, the sealing force along the sealing surface 36*a* corresponds to an amount of ink pressure, for example, from the ink provided through the channel 37. The compliant member 34 may include foam rubber.

FIG. 4B is an exploded perspective view of a portion of FIG. 4A according to an example of the present disclosure. Referring to FIG. 4B, in an example, a first nip 42 is formed between the developer roller 35*a* and the squeegee roller 35*b* subjected to a high ink pressure at least due to rotational direction of the respective rollers 35*a* and 35*b*. A second nip 43 is formed between the developer roller 35*a* and the cleaner roller 35*c* subjected to a low ink pressure at least due to rotational direction of the respective rollers 35*a* and 35*c*. A portion of the sealing member 36 may be disposed within the first nip 42 and another portion of the sealing member 36 may be disposed within the second nip 42. An amount of interference of the portion of the sealing member 36 with the developer roller 35*a* in the first nip 42 exceeds an amount of interference of the other portion of the sealing member 36 with the developer roller 35*a* in the second nip 43. In the present example, the amount of interference of the portion of the sealing member 36 with the developer roller 35*a* in the first nip 42 is at a maximum and the amount of interference of the other portion of the sealing member 36 with the developer roller 35*a* in the second nip 43 is at a minimum.

Referring to FIG. 4B, in an example, the rotational direction of the developer roller 35*a* is in a clockwise direction and the rotational direction of the squeegee roller 35*b* is in a counterclockwise direction. Accordingly, a portion of the sealing member 36 including the sealing surface 36*a* such as wool felt is sufficiently pulled into the first nip due to frictional forces acting on the sealing member 36 resulting from contact with the respective spinning rollers. The rigid base member 32 attached to the housing unit 31 prevents the sealing device 30 from being pulled entirely through the first nip 42. In an example, the low elongation properties of the sealing member 36 and direct attachment to the base member 32 allow the sealing member 36 to be pulled into, but not entirely through, the first nip 42. The rotational direction of the cleaner roller 35*b* is in a counterclockwise direction. Thus, a high localized ink pressure region is not created at the second nip 43. Accordingly, a sufficient seal is formed by the other portion of the sealing member 36 being disposed thereat without being pulled into the second nip 43. In operation, the sealing device 30 forms a seal by adjusting the sealing force to correspond with the variation in localized pressures. Thus, the sealing device 30 may compensate for manufacturing tolerances and have high durability.

Referring to FIG. 4B, the sealing device 30 may include a first side portion 30*a* configured to conform to the circumferential surface $s_{cb}$ of the squeegee roller 35*b*. The sealing device 30 may also include a second side portion 30*b* configured to conform to the circumferential surface $s_{cc}$ of the cleaner roller 35*c*. For example, the first side portion 30*a* and the second side portion 30*b* may have a concave shape corresponding to a convex shape of the respective circumferential surfaces $s_{cb}$ and $s_{cc}$ of the squeegee roller 35*b* and the cleaner roller 35*c*, respectively. The sealing member 36 may conform to the circumferential surface $s_{ca}$ of the developer roller 35*a*. In the present example, the sealing device 30 may comprise a shape in a form of a T-shape.

Figure 4C:
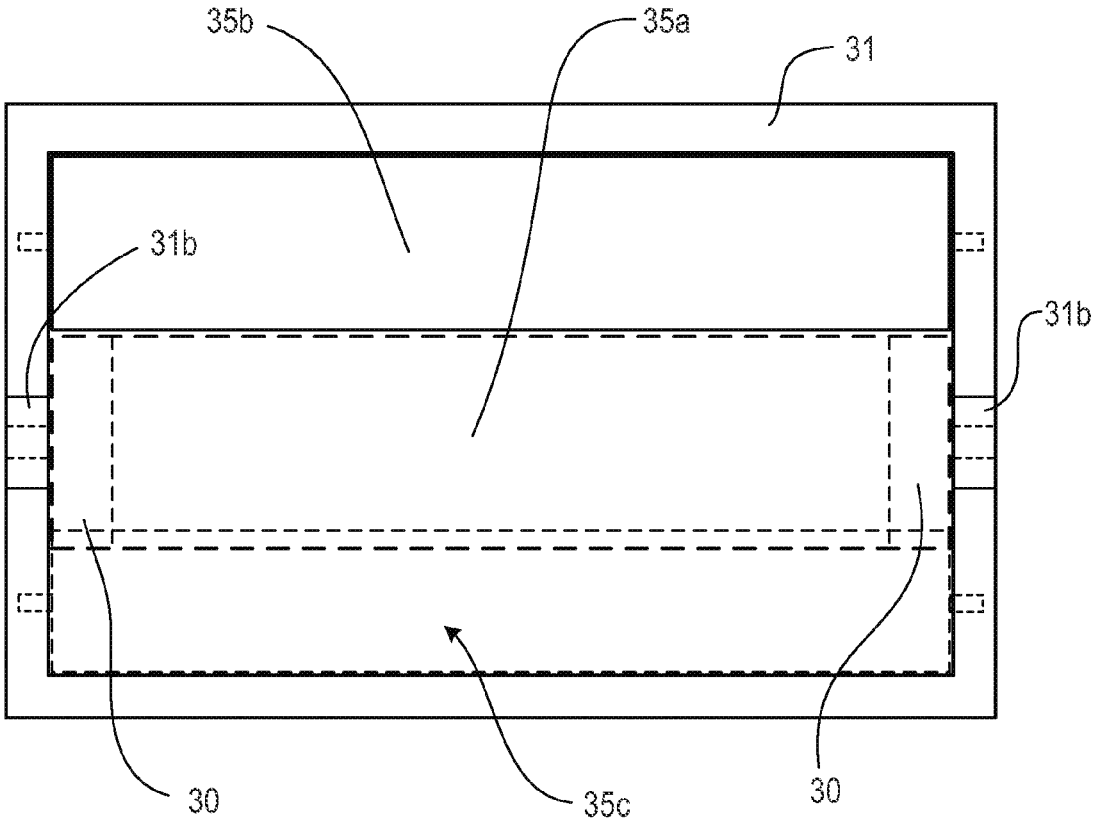
FIG. 4C is an end elevation view of the ink developer unit of FIG. 4A according to an example of the present disclosure.

FIG. 4C is an end elevation view of the ink developer unit of FIG. 4A according to an example of the present disclosure. Referring to FIG. 4C, the ink developer unit 39 includes two sealing devices 30. The sealing devices 30 may be spaced apart from each other and in contact with each of the respective circumferential surfaces $s_{ca}$, $s_{cb}$, and $s_{cc}$ of the developer roller 35*a*, squeegee roller 35*b* and the cleaner roller 35*c*.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A sealing device usable with an ink developer unit, the sealing device comprising:
- a base member configured to attach to the ink developer unit;
- a sealing member having a sealing surface configured to limit an unwanted flow of ink from inside to outside of the ink developer unit; and
- a compliant member disposed between the base member and the sealing member, the compliant member configured to vary a sealing force along the sealing surface of the sealing member.

2. The sealing device according to claim 1, wherein the sealing force is varied corresponding to an amount of ink pressure.

3. The sealing device according to claim 1, wherein the sealing surface of the sealing member is configured to conform to a respective roller of the ink developer unit.

4. The sealing device according to claim 1, wherein the base member is configured to removably attach to the ink developer unit.

5. The sealing device according to claim 1, wherein the compliant member comprises foam rubber, the sealing member comprises wool felt, and the ink comprises liquid toner.

6. An ink developer unit, comprising:
- a housing unit;
- a plurality of rollers rotatably attached to the housing unit;
- a channel disposed within the housing unit configured to provide ink to one of the rollers; and
- at least one sealing device disposed within the housing unit, comprising:
  - a base member;
  - a sealing member having a sealing surface configured to conform to an outer surface of the one roller; and
  - a compliant member disposed between the base member and the sealing member, the compliant member configured to vary a sealing force along the sealing surface of the sealing member.

7. The ink developer unit according to claim 6, wherein the sealing member conforms to a circumferential surface of a developer roller configured to supply a film of ink to be selectively transferred to a photoconductive drum.

8. The ink developer unit according to claim 6, wherein the sealing force along the sealing surface corresponds to an amount of ink pressure.

9. The ink developer unit according to claim 6, wherein the sealing surface is configured to limit an unwanted flow of ink from inside to outside of the ink developer unit.

10. The ink developer unit according to claim 6, wherein the plurality of rollers comprise:
- a developer roller configured to supply a film of ink to be selectively transferred to a photoconductive drum;
- a squeegee roller configured to compact the ink on the developer roller to form a uniform layer thereon; and
- a cleaner roller configured to remove access ink remaining on the developer roller and not previously transferred to the photoconductive drum.

11. The ink developer unit according to claim 10, wherein the sealing device further comprises:
- a first side portion configured to conform to a circumferential surface of the squeegee roller;
- a second side portion configured to conform to a circumferential surface of the cleaner roller; and
- the sealing member is configured to conform to a circumferential surface of the developer roller.

12. The ink developer unit according to claim 10, wherein a portion of the sealing member is disposed within a nip formed between the developer roller and the squeegee roller.

13. The ink developer unit according to claim 6, further comprising:
- a pair of electrodes removably holding the base member of the at least one sealing device.

14. The ink developer unit according to claim 6, wherein the compliant member comprises foam rubber and the sealing member comprises wool felt.

15. The ink developer unit according to claim 6, wherein the at least one sealing device comprises two sealing devices, each sealing device comprises a shape in a form of a T-shape.

* * * * *